United States Patent [19]

Danforth et al.

[11] 4,365,003

[45] Dec. 21, 1982

[54] SILICATE TREATMENT FOR COATED SUBSTRATE

[75] Inventors: Claudia L. Danforth, Chardon; Jon A. deRidder, Madison, both of Ohio

[73] Assignee: Diamond Shamrock Corporation, Dallas, Tex.

[21] Appl. No.: 224,094

[22] Filed: Jan. 12, 1981

[51] Int. Cl.[3] ..... B22F 5/00; C23F 7/24

[52] U.S. Cl. ..... 428/552; 428/558; 428/560; 148/6.2

[58] Field of Search ..... 148/6.14 R, 6.2, 6.27; 428/552, 558, 560

[56] References Cited

U.S. PATENT DOCUMENTS

| | | | |
|---|---|---|---|
| 3,687,738 | 8/1972 | Malkin | 148/6.2 |
| 3,819,425 | 6/1974 | DeRidder et al. | 148/6.16 |
| 3,907,608 | 9/1975 | Barrett et al. | 148/6.2 |
| 4,222,779 | 9/1980 | Bengali et al. | 106/14.12 |

FOREIGN PATENT DOCUMENTS

| | | |
|---|---|---|
| 50-23096 | 2/1975 | Japan . |
| 51-145906 | 3/1976 | Japan . |
| 51-51128 | 5/1976 | Japan . |
| 53-108834 | 9/1978 | Japan . |
| 53-125329 | 11/1978 | Japan . |

*Primary Examiner*—Sam Silverberg
*Attorney, Agent, or Firm*—John J. Freer

[57] ABSTRACT

Metals, particularly ferrous metals, coated for corrosion resistance with coatings containing particulate metal and hexavalent chromium-providing substance can now be made further corrosion resistant, as well as heat resistant, with a topcoat of silica substance. In addition, mar resistance plus improved outdoor weathering is also achieved, without sacrifice to other characteristics, e.g., coating adhesion.

14 Claims, No Drawings

SILICATE TREATMENT FOR COATED SUBSTRATE

BACKGROUND OF THE INVENTION

It has been known to protect zinc surfaces such as galvanized steel by using silicate treatments, e.g., a coating of potassium water glass, to provide corrosion resistance for the zinc surface. Such coatings ostensibly compare favorably with zinc substrates that are chromate treated.

It is also known in the protection of zinc surfaces, which have been first treated by a traditional chromate coating, to topcoat the treated surface with colloidal silicas or silicate solutions. this further protection against white rusting can be obtained with films such as from silicate solutions of sodium silicate and/or potassium silicate. In addition to retarding white rusting, the topcoating can also retard staining, as has been discussed in Japanese Patent Disclosure No.: Showa 53-125239.

Moreover, the application of protective coatings of silicate directly on iron surfaces has been previously shown. Such may be achieved by direct application of silicate materials to the iron surface or by precipitation of collodial silicas onto an iron surface. The transitory corrosion protection thereby provided the ferrous substrate is well known.

Further in the protection of ferrous surfaces, it has been known to mix hexavalent chromium compounds and silicate materials in the same coating composition. These can typically be emulsions containing resinous materials. Emulsives may include polyacrylic acid, and coating operations can proceed in conventional manner to achieve corrosion protection for the ferrous surface.

A variety of at least substantially resin free, chromium-containing coatings for protecting ferrous substrates are also known. Of especial interest are those which contain particulate metal. Representative coating compositions can be relatively simplistic such as the compositions that may essentially contain chromic acid, and particulate metal in an alcohol medium, as disclosed in U.S. Pat. No. 3,687,738. Other, more complex compositions such as shown in U.S. Pat. No. 3,907,608 may contain the pulverulent metal and hexavalent-chromium-providing substance in a liquid medium comprising water plus high-boiling organic liquid. Such coatings over ferrous surfaces provide a highly desirable protection against red rust upon exposure of the surface to salt solution.

SUMMARY OF THE INVENTION

It has now been found that substrates, and especially ferrous substrates, protected as described hereinabove with resin free compositions of particulate metal and hexavalent-chromium-providing substance, can have outstanding corrosion protection against rust, in both exposure to salt conditions and weathering conditions, without composition additive. Such substrates of improved protection are now achieved using silica topcoatings which further provide heat resistance for the coating upon exposure to elevated temperatures. Corrosion resistance improvement, as demonstrated against salt solutions, can be extraordinary, for example, up to 5 times further improvement against red rust.

Moreover, the present invention obtains such effects in straight-forward coating operation. Although not wanting to be bound by any particular theory of the invention, it appears that during topcoating operation, microscopic pores of the undercoating are sealed, but without deleterious affect to the electroconductivity of the undercoating, which is a critical protection mechanism whereby the undercoating proceeds through sacrificial action to protect the underlying substrate. In addition to such corrosion resistance, as well as the above-noted heat resistance, the coating composite provides other characteristics including improved mar resistance, achieved without sacrifice to further desirable features, e.g., coating adhesion.

The foregoing aspects of the invention are now achieved by a coated metal substrate protected with a coating composite, wherein at least a portion of the coating composite is substantially resin free and comprises an undercoating and a subsequent coating, each established from compositions curable to water insoluble protective coatings with the undercoating being applied as a composition containing, in liquid medium, a hexavalent-chromium-providing substance plus particulate metal, and the topcoating containing silicate substance in liquid medium in an amount sufficient to provide above about 50 milligrams per square foot of coated substrate of silica substance in cured topcoating.

DESCRIPTION OF THE PREFERRED EMBODIMENTS

The undercoatings need not be complex and yet form highly desirable, corrosion resistant coatings on the substrate metal surface after curing at elevated temperature. Some of the very simple undercoating compositions, such as have been taught in U.S. Pat. No. 3,687,738, can merely contain chromic acid and a particulate metal such as aluminum, manganese, zinc and magnesium, in liquid medium.

Substantially all of the undercoating compositions are simply water based, for economy. But for additional or alternative substances, to supply the liquid medium at least for some of these compositions, there have been taught, as in U.S. Pat. No. 3,437,531, blends of chlorinated hydrocarbons and a tertiary alcohol including tertiary butyl alcohol as well as alcohols other than tertiary butyl alcohol. In the selection of the liquid medium, economy will generally be of major importance, and thus such medium will most always contain readily commercially available liquids.

Particularly preferred undercoat compositions, for enhanced coating adhesion as well as corrosion resistance, will contain thickeners, such as water soluble cellulose ethers and will also contain high boiling organic liquid. For economy, these particular coating compositions preferably contain between about 0.01–3 weight percent of water soluble cellulose ether, such as hydroxethylcellulose, methylcellulose, methylhydroxypropylcellulose, ethylhydroxyethylcellulose, methylethylcellulose or mixtures of these substances. Although the cellulose ether needs to be water soluble to augument thickening for these particular coating compositions, it need not be soluble in the high boiling organic liquid, which liquid can contribute up to 50 volume percent of the coating composition based on the total volume of liquid in the coating composition. Such organic liquid, when present, also can supply substantially above about 5 volume percent, and advantageously above about 15 volume percent, both on the same basis as for the 50 volume percent, of the coating composition liquid.

For the particularly preferred undercoat compositions, the organic liquid has a boiling point at atmospheric pressure above 100° C., while preferably being water soluble. The organic liquids contain carbon, oxygen and hydrogen and have at least one oxygen-containing constituent that may be hydroxyl, or oxo, or a low molecular weight ether group, i.e., a $C_1$–$C_4$ ether group, so that for convenience such liquids can be referred to as "oxohydroxy liquids." Since water dispersibility and preferably water solubility is sought, polymeric hydrocarbons are not particularly suitable and advantageously serviceable hydrocarbons contain less than about 15 carbon atoms. Particular hydrocarbons which may be present in these preferred undercoating compositions include tri-, and tetraethylene glycol, di- and tripropylene glycol, the monomethyl, dimethyl, and ethyl ethers of these glycols, as well as diacetone alcohol, the low molecular weight ether of diethylene glycol, and mixtures of the foregoing. Representative preferred coating compositions have been discussed in U.S. Pat. No. 3,907,608.

The particular metal of the undercoating can in general be any suitable electrically conductive metallic pigment such as finely divided aluminum, manganese, cadmium, steel, magnesium or zinc and is most particularly zinc dust or zinc flake or aluminum flake, including mixtures thereof. Flake may be blended with pulverulent metal powder, but typically in only minor amounts of powder. The metallic powders typically have particle size such that all particles pass 100 mesh and a major amount pass 325 mesh ("mesh" as used herein is U.S. Standard Sieve Series). The powders are generally spherical as opposed to the leafing characteristic of the flake.

The undercoating weight on the coated substrate may vary to a considerable degree but, exclusive of the metal flake, will most typically always be present in an amount supplying above about 5 milligrams per square foot of chromium, expressed as chromium and not $CrO_3$. For extended corrosion resistance, such may contain up to about 500 milligrams per square foot of chromium. Generally, the coating should have a weight ratio of chromium, expressed as chromium and not $CrO_3$, to pulverulent metal of less than about 0.5:1, and such ratio is most usually for the less heavy coatings weights, since as the coating weight approaches, for example, 5000 milligrams per square foot of pulverulent metal, the weight ratio of chromium to pulverulent metal will be less than about 0.2:1. For such less heavy coatings, the undercoating will often contain about 10–200 milligrams per square foot of coated substrate of pulverulent metal.

Other compounds may be present in the undercoating composition, and/or in the topcoating composition, but even in combination are present in very minor amounts, such as on the order of 10 grams per liter or less for the undercoating and 5 weight percent or less for the topcoating, so as not to deleteriously affect the coating integrity, e.g., with respect to electroconductivity and galvanic protection. Both the undercoating and the topcoating should be substantially resin free; and for the undercoating, this is exclusive of any thickening and/or dispersing agents which may be present. To be substantially resin free, the undercoating and topcoating compositions should each contain less than about 10 grams per liter of resin and preferably are completely resin free.

The protected substrate can be any substrate, and particularly a metal substrate, that can withstand the heat curing conditions for the coatings but is most usually a ferrous substrate. Especially where such are metal substrates, these may be pretreated, e.g., by chromate or phosphate treatment, prior to application of the undercoating. After undercoating application, it is preferred for best corrosion resistance to subsequently heat the applied coating. The preferred temperature for the subsequent heating, which is also often referred to as curing and which may be preceded by drying such as air drying, is within the range from about 350° F. at a pressure of 760 mm Hg up to not essentially above about 1000° F. Preheating the substrate prior to application of the liquid composition will assist in achieving cure temperature. However, such curing temperatures do not often exceed a temperature within the range of about 450°–700° F. At the elevated curing temperatures, the heating can be carried out in as rapidly as about a few seconds, but curing is often conducted for several minutes at a reduced temperature.

The term "silica substance" as it is used herein is intended to include both silicates and collodial silicas. The collodial silicas include both those that are solvent based as well as aqueous systems with the water based collodial silicas being most advantageous for economy. As is typical, such collodial silicas can include additional ingredients, e.g., thickeners, as, for example, up to about 5 weight percent of an above-discussed water soluble cellulose ether. In general, the use of collodial silicas will provide for heavier topcoats of silica substance over undercoated substrate materials. It is contemplated to use collodial silicas containing up to 50 percent by weight of solids, but typially, such more concentrated silicas will be diluted, for example, where spray application of the topcoat will be used. Advantageously, for economy, such dilution provides collodial silicas containing not less than 1 to 2 weight percent solids. Most advantageously for achieving desirable topcoating weights combined with ease of application, such collodial silicas will contain from about 5 weight percent to about 40 weight percent solids.

When the topcoating silica substance is silicate, it may be organic or inorganic. The organic silicates that can be, or have been, useful include the alkyl silicates, e.g., ethyl, propyl, butyl and polyethyl silicates, as well as alkoxyl silicates such as ethylene glycol monoethyl silicate, tetra isobutyl silicate and tetra isopropyl silicate, and further including aryl silicates such as phenyl silicates. Most generally for economy, the organic silicate is ethyl silicate. Advantageously, the inorganic silicates are used for best economy. These are typically employed as aqueous solutions, but solvent based dispersions may also be used. When used herein in reference to silicates, the term "solution" is meant to include true solutions and hydrosols. The preferred inorganic silicates are the aqueous silicates that are the water soluble silicates including sodium, potassium, lithium, sodium/lithium combinations, as well as other related combinations, and ammonium including quaternary ammonium as well as mixtures of the foregoing. Referring to sodium silicate as representative, the mole ratios of $SiO_2$ to $Na_2O$ generally range between 1:1 and 4:1. It is preferred to use, for economy, those silicates which are most readily commercially available, generally having a mole ratio of $SiO_2$ to $Na_2O$ of from about 1.8:1 to about 3.5:1. For best efficiency and economy, an aqueous based sodium silicate is preferred as the silica substance.

The silicate should contain from at least 0.5 weight percent solids, and may contain up to about 50 weight percent solids or more. Advantageously, for efficiency in achieving a desirable coating weight, the silicate will contain at least about 1 weight percent solids. It is conventional in the industry for some coating applications to remove excess coating by rapidly rotating freshly coated parts maintained in a basket. This is usually referred to as the "dip spin" coating method, as the coating is typically first achieved by placing fresh parts for coating in the basket and then dipping same into coating composition. For efficient coatings regardless of coating operation technique, it is preferred that the silicate contain above about 10 weight percent solids up to about 40 weight percent.

The silica substance topcoating may be applied by various techniques such as immersion techniques including dip drain and dip spin procedures. Where parts are compatible with same, the coating can be by curtain coating, brush coating or roller coating and including combinations of the foregoing. It is also contemplated to use spray technique as well as combinations, e.g., spray and spin and spray and brush techniques. It is advantageous to topcoat articles that are at elevated temperature, as from curing of the undercoating, by a procedure such as dip spin, dip drain or spray coat. By such operation, some to all of the topcoat curing is achieved without further heating.

By any coating procedure, the topcoat should be present in an amount above about 50 mgs./sq.ft. of coated substrate. This is for the cured silica substance topcoating. For economy, topcoat weights for cured topcoating will not exceed about 2000 mgs./sq.ft. Most typically, the heavier coating weights, e.g., from about 500–1500 mgs./sq.ft. of coated substrate will be provided by the collodial silicas. The silicate topcoating compositions will most typically provide from about 100–1000 mgs./sq/ft. of coated substrate of cured silicate topcoating. Preferably, for best efficiency and economy, the topcoat is an inorganic silicate providing from about 200 to about 800 mgs./sq.ft. of cured silicate topcoating.

For the curing, it is typical to select the curing conditions in accordance with the particular silica substance used, it being important that the topcoating be cured from a water sensitive coating to one that is water resistant. For the colloidal silicas, air drying may be sufficient; but, for efficiency, elevated temperature curing is preferred for all of the silica substances. The elevated temperature curing can be preceded by drying, such as air drying. Regardless of prior drying, lower cure temperatures, e.g., on the order of about 150° F. to about 300° F. will be useful for the colloidal silicas and organic silicates. For the inorganic silicates, curing typically takes place at a temperature on the order of about 300° F. to about 500° F. Thus, in general, cure temperatues on the order of from about 150° F. to about 1000° F. are useful. Cure temperatures reaching above about 1000° F. are uneconomical and undesirable. For best cure efficiency, the topcoats are typically cured at temperatures within the range from about 200° F. to about 500° F. The more elevated temperatures, e.g., on the order of about 500° F. to about 900° F. can be serviceable to likewise cure the undercoat during topcoat cure, but such single cure procedure is not preferred for best corrosion protection of the coated substrate.

Before coating, it is in most cases advisable to remove foreign matter from the substrate surface, as by thououghly cleaning and degreasing. Degreasing may be accomplished with known agents, for instance, with agents containing sodium metasilicate, caustic soda, carbon tetrachloride, trichlorethylene, and the like. Commercial alkaline cleaning compositions which combine washing and mild abrasive treatments can be employed for cleaning, e.g., an aqueous trisodium phosphate-sodium hydroxide cleaning solution. In addition to cleaning, the substrate may undergo cleaning plus etching.

The following examples show ways in which the invention has been practiced but should not be construed as limiting the invention. In the examples, the following procedures have been employed:

Preparation of Test Parts

Test parts are typically prepared for coating by first immersing in water which has incorporated therein 2–5 ounces of cleaning solution per gallon of water. The alkaline cleaning solution is a commercially available material of typically a relatively major amount by weight of sodium hydroxide with a relatively minor weight amount of a water-softening phosphate. The bath is maintained at a temperature of about 150°–180° F. Thereafter, the test parts are scrubbed with a cleaning pad which is a porous, fibrous pad of synthetic fiber impregnated with an abrasive. After the cleaning treatment, the parts are rinsed with warm water and may be dried.

Application of Coating to Test Parts and Coating Weight

Clean parts are typically coated by dipping into coating composition, removing and draining excess composition therefrom, sometimes with a mild shaking action, and then immediately baking or air drying at room temperature until the coating is dry to the touch and then baking. Baking proceeds in a hot air convection oven at temperatures and with times as specified in the examples.

Coating weights for parts, generally expressed as a weight per unit of surface area, are typically determined by selecting a random sampling of parts of a known surface area and weighing the sample before coating. After the sample has been coated, it is reweighed and the coating weight per selected unit of surface area, most always presented as milligrams per square foot (mg./sq.ft.), is arrived at by straightforward calculation.

Corrosion Resistance Test (ASTM B-117-64) and Rating

Corrosion resistance of coated parts is measured by means of the standard salt spray (fog) test for paints and varnishes ASTM B-117-64. In this test, the parts are placed in a chamber kept at constant temperature where they are exposed to a fine spray (fog) of a 5 percent salt solution for specified periods of time, rinsed in water and dried. the extent of corrosion on the test parts is determined by comparing parts one with another, and all by visual inspection.

EXAMPLE 1

To 55 milliliters (mls.) of dipropylene glycol (DPG), there is blended with moderate agitation 1.0 ml. of a nonionic wetter having a viscosity in centipoises at 25° C. of 280 and a density at 25° C. of 10 pounds per gallon, and 1.0 gram (gm.) of hydroxypropyl methyl cellulose thickener. The thickener is a very finely-divided cream to white colored powder. To this thickener mixture there is then added 84 grams of a flaked zinc/aluminum mixture, providing 75.5 gms. zinc and 8.5 gms. aluminum, using agitation during the addition. The zinc flake has particle thickness of about 0.1–0.5 micron and a longest dimension of discrete particles of about 80 microns.

Separately there is added to 88 ml. of deionized water 12.5 gms. of $CrO_3$, and to this there is added an additional 88 ml. of deionized water. To this chromic acid solution is added about 3 gms. of zinc oxide. The resulting chromic acid solution is slowly added to the metal flake dispersion to form an undercoating composition.

For topcoats there are employed either a commercially available sodium silicate having 21.7 weight percent solids in a water medium and a ratio of $SiO_2/Na_2O$ of 3.22, or a commercially available ethyl silicate containing about 18 percent $SiO_2$ by weight and having a viscosity of 7 centipoises at 20° C. and a density of 8.3 pounds per gallon at 68° F.

The parts for testing are 4×8 inch test panels that are all cold-rolled, low-carbon steel panels. These panels are cleaned and coated, initially either with undercoating alone or topcoating alone, and then some undercoated panels are topcoated, all in the manner described hereinbefore. A cleaned but uncoated panel is retained for test purposes. After coating with the undercoating, panels are baked for 10 minutes in a convection oven having a hot air temperature of 575° F. Topcoated panels are also thusly baked, but at an air temperature of 350° F. and for 20 minutes for the sodium silicate topcoat ("Na Silicate" in the table), and at an air temperature of 200° F. and for 15 minutes for the ethyl silicate topcoat.

Panels are then subjected to the hereinbefore described corrosion resistance test. The coating, curing and testing results are summarized hereinbelow in the table.

TABLE 1

| Coating | Coating Weight (mg./ft.$^2$)* | Curing (°F.-min.) | Salt Spray % Corrosion** |
|---|---|---|---|
| None | 0 | None | 100% (7 hrs.) |
| Ethyl Silicate | 494 | 200° F.-15 min. | 100% (7 hrs.) |
| Na Silicate | 443 | 350° F.-20 min. | 40% (72 hrs.) |
| Undercoat | 538 | 575° F.-10 min. | 68% (1032 hrs.) |
| Undercoat & Ethyl Silicate | 536 & 529 | 575° F.-10 min. & 220° F.-15 min. | 0% (1032 hrs.) |
| Undercoat & Na Silicate | 536 & 457 | 575° F.-10 min. & 350° F.-10 min. | 0% (1032 hrs.) |

*All average of two panels, except "none."
**Percent Corrosion on panel field.

EXAMPLE 2

The topcoating and undercoating combination of the invention is especially useful for subsequently scratched surfaces. To demonstrate this, the undercoating of Example 1 was again used in the manner hereinbefore described to coat test panels as described in Example 1. Some undercoated panels are set aside for testing while others are undercoated a second time, or topcoated, as shown in the table below. The topcoats and topcoating procedures, including curing, all as hereinbefore discussed, are again employed.

Prior to subjecting test panels to corrosion resistance testing, panels are scribed across the face of the panel, in an "X" configuration to expose the basis metal along scribe lines. Corrosion resistance results are thereafter determined by visually observing the scribe lines and the remaining "field" of the exposed panel face. The results of such testing are shown hereinbelow in the table.

TABLE 2

| Coating | Coating Weight (mg./ft.$^2$)* | Salt Spray: % Corrosion 3216 Hours* Field | Scribe |
|---|---|---|---|
| Undercoat | 1011 | 60%** | 100** |
| Undercoat + Undercoat | 1008 + 702 | 6% | 68% |
| Undercoat + Ethyl Silicate | 1005 + 562 | 10% | 8% |
| Undercoat + Na Silicate | 1005 + 521 | 5% | 25% |

*All coating weights and test results are determined from at least two panels, so that all figures presented are averages.
**2568 hours.

EXAMPLE 3

In this test, bolts, as more specifically described hereinbelow, are used. The bolts are coated by placing in a wire basket and dipping the basket into coating composition, removing the basket and draining excess composition therefrom.

The undercoating used as the initial coat for all bolts is the same as described in Example 1. Some undercoated bolts are set aside for testing, while others are undercoated a second time, or topcoated as shown in the table below. For each topcoat, the procedure involved uses the wire basket and dipping.

In all cases, draining is then followed by baking. The bolts are usually placed on a sheet for baking. Baking proceeds at an air temperature of about 575° F. for a time up to 15 minutes for the undercoating on each part and also where the undercoating is used as the topcoating. For other topcoats, the baking procedures are as follows: for the acrylic paint, 320° F. for 12 minutes; for the sodium silicate, 350° F. for 20 minutes; and for the ethyl silicate, 200° F. for 20 minutes.

The sodium silicate and ethyl silicate topcoats used are those as have been described in Example 1. The acrylic paint is a commercially available, water-based acrylic of water-white appearance.

The hex-head bolts used in the test are a specific grade of 9.8 bolts which more particularly are 1½ inches long by about 5/16 inch in diameter at the threaded end and have 1 3/16 inch of threading on the shaft that terminates in the bolt head. Coating weights for the bolts are determined and results of such determination are shown in the table below.

Coated bolts are then subjected to corrosion resistance testing. The results of such testing are shown in the table below.

TABLE 3

| Topcoat | Coating Weight (mg./ft.$^2$) | Salt Spray: % Corrosion 744 Hours Heads | Threads |
|---|---|---|---|
| None | 0 | 100* | 100* |
| Undercoat | 480 | 42 | 70 |
| Acrylic Paint | 660 | 100* | 100* |
| Na Silicate | 580 | 0 | 0 |

TABLE 3-continued

| Topcoat | Coating Weight (mg./ft.$^2$) | Salt Spray: % Corrosion 744 Hours Heads | Threads |
|---|---|---|---|
| Ethyl Silicate | 435 | 0 | 0 |

*288 Hours

EXAMPLE 4

The undercoating of Example 1 was again used in the manner hereinabove described to coat test panels, which have been described in Example 1. Some undercoated panels are taken for topcoating. One topcoat was the sodium silicate solution of Example 1, but having a 20 weight percent solids content. It was applied in the manner described hereinbefore followed by baking for 5 minutes at 210° F. which was followed by baking for 10 minutes at 350° F.

A second topcoat, applied in the manner described above, was an aqueous acrylic dispersion resin, having at first a 36 weight percent solids content, a pH of 7.4 and a density of 8.7 pounds per gallon. Before use, this dispersion was diluted with deionized water to 25 weight percent solids. The applied resin was cured at elevated temperature in a convection oven. A third topcoat, applied as described above, was a colloidal silica having at first a 50 weight percent solids content, a pH of 8.5, an approximate $Na_2O$ content of 0.25 percent and viscosity of 10 centipoises. Before use, this colloidal silica was diluted to 40 percent solids content with deionized water. Three test panels containing this topcoat were separately cured as follows: one was air dried for 24 hours; one baked at 350° F. for 5 minutes; and one baked at 250° F. for 5 minutes.

Coating weights, determined for all panels, are reported below in the table. Panels are then subjected to corrosion resistance testing and results are shown in the table.

TABLE 4

| Coating | Coating Weight (mg./ft.$^2$) | Salt Spray: % Corrosion 1920 Hours |
|---|---|---|
| Undercoat | 1087 | 52 |
| Undercoat + Acrylic Topcoat | 1082 + 145 | 60 |
| Undercoat + Na Silicate Topcoat | 1148 + 860 | 5 |
| Undercoat + Colloidal Silica Topcoat* | 1146 + 1140 | 10 |

*Figures presented are average of three test panels.

The foregoing results demonstrate the acceptability of the colloidal silica for topcoating purposes. Although the silica and silicate topcoating weights are substantial, as when compared with the acrylic topcoat, the performance in each instance is acceptable. Most notably, the acrylic topcoat, although present in lesser amount, actually downgrades corrosion resistance, when compared to the use of the undercoating by itself.

EXAMPLE 5

The test pieces for coating are bolts as have been described in Example 3. The bolts are coated by placing in a wire basket and dipping the basket into coating composition. The bolts are then placed on a sheet for baking which proceeds in a convection oven at an air temperature of about 575° F. and for a time up to 15 minutes. The undercoating weight for all bolts is measured by a method such as the one described hereinbefore in connection with the examples.

Sets of coated bolts are then topcoated in several solutions of the sodium silicate desribed in Example 1, except the solids concentration varies from 0.8 to 20 weight percent solids, as shown in the table below. The bolts are topcoated using a wire basket and dipping as described above. In some cases, the basket is removed from coating composition and excess composition is thereafter drained from the bolts with a mild shaking action. This is the "dip drain" method or, as shown in the table, "none" for spin coating removal. For other test batches, the wire basket is removed from the coating composition and excess composition is thereafter removed by rapidly spinning the basket, either at a rate of 200 rpm or at 400 rpm, as shown in the table below. This is the "dip spin" coating method. Whether parts are thus spun or simply drained and shaken, all parts are then immediately baked. In all cases, topcoated bolts are baked at first for 7 minutes at 205° F. followed by 15 minutes at 400° F.

The outdoor weathering resistance of the bolts, including a control that is simply undercoated, is evaluated by exposing the bolts on a stand with the bolts facing southwest inclined at an angle of 45 degrees to the vertical in Chardon, Ohio. Bolts are evaluated by visual inspection in regards to total percentage of red rust on all exposed surfaces, the results of such testing are shown in the table below.

TABLE 5

| Coating | Topcoat % Solids | Spin Coating Removal | Outdoor Weathering % Rust: Five Months Heads | Threads |
|---|---|---|---|---|
| Undercoat | None | None | 90% | 100% |
| Undercoat + Topcoat | Silicate 0.8% | 400 RPM | 87% | 88% |
| | | 200 RPM | 97% | 99% |
| | | None | 83% | 66% |
| Undercoat + Topcoat | Silicate 4% | 400 RPM | 78% | 51% |
| | | 200 RPM | 45% | 24% |
| | | None | 29% | 25% |
| Undercoat + Topcoat | Silicate 8% | 400 RPM | 48% | 34% |
| | | 200 RPM | 20% | 18% |
| | | None | 50% | 16% |
| Undercoat + Topcoat | Silicate 20% | 400 RPM | 50% | 41% |
| | | 200 RPM | 22% | 8% |
| | | None | 11% | 8% |

From the foregoing, it will be noted that a low solids content for the silicate topcoating will generally not provide desirably enhanced outdoor weathering resistance, whether excess coating is removed by dip drain or dip spin technique. Repetitive coating is thus recommended under such circumstances. Also as noted in the table, at about the 10 percent solids level for the silicate topcoat, significant corrosion protection improvement is achieved, by both dip spin and dip drain coating application technique. As the solids level for the silicate topcoat becomes more elevated, i.e., as it approaches the 20 percent solids content, the dip drain procedure for removing excess topcoat becomes preferable for obtaining best enhancement for corrosion resistance in outdoor weathering.

What is claimed is:

1. A coated metal substrate protected with an undercoating/topcoating composite which is resin-free and contains particulate metal, with the proviso that only the undercoating of the composite contains the particulate metal while the total of the coating composite is substantially resin-free, each coating being established from compositions curable to water resistant protective coatings, with the undercoating being applied as a substantially resin free composition containing, in liquid medium, a hexavalent-chromium-providing substance plus the particulate metal and in an amount sufficient to provide, upon curing, above 10 but not substantially above about 5000 milligrams per square foot of coated substrate of particulate metal, and said topcoating being substantially resin free and containing silica substance in liquid medium in an amount sufficient to provide above about 50 milligrams per square foot of coated substrate of silica substance in cured coating.

2. The coated metal substrate of claim 1 characterized by having said undercoating as the first coating on the surface of said substrate.

3. The coated metal substrate of claim 1 further characterized by having a liquid medium of both said undercoating and said subsequent coating containing water.

4. The coated metal substrate of claim 3 wherein said undercoating liquid medium comprises water plus high-boiling organic liquid.

5. The coated metal substrate of claim 1 wherein said undercoating is established from a heat-curable composition.

6. The coated metal substrate of claim 5 wherein said undercoating is obtained after heating at a temperature above about 350° F. and said topcoating is obtained after heating at a temperature within the range from about 200° F. to about 1000° F.

7. The coated metal substrate of claim 1 wherein at least a portion of the particulate metal of said undercoating is in flake form.

8. The coated metal substrate of claim 1 wherein said undercoating contains not above about 500 milligrams per square foot of coated substrate of chromium, with the coating containing a weight ratio of chromium, as chromium, to particulate metal of not substantially above about 0.5:1.

9. The coated metal substrate of claim 1 wherein said topcoating upon curing provides not substantially above about 2000 milligrams per square foot of coated substrate of said silica substance.

10. The method of preparing a corrosion resistant coated metal substrate protected with a particulate-metal-containing undercoating/topcoating composite, wherein only the undercoating contains said particulate metal, which method comprises applying, as the undercoating a substantially resin free, heat-curable composition containing a hexavelent-chromium-providing substance plus particulate metal in a liquid medium and in an amount sufficient to provide, upon curing, above 10 but not substantially above about 5000 milligrams per square foot of coated substrate of particulate metal, and applying as a topcoating on said undercoating a substantially resin free composition curable to a water resistant protective coating and containing silica substance in liquid medium, said topcoating being in an amount sufficient to provide above about 50 milligrams per square foot of coated substrate of silica substance.

11. The method of claim 10 wherein said undercoating is heat cured prior to application of said topcoating.

12. The method of claim 10 wherein said undercoating is established, by heating, as a dry and water-resistant undercoating, and said topcoating is thereafter applied without intermediate cooling.

13. In the method of preparing a corrosion resistant coated metal substrate protected with a pulverulent-metal-containing undercoating/topcoating composite, where only the undercoating contains the pulverulent metal, and where said substrate has as said undercoating a substantially resin free coating extablished from a heat-curable composition containing a hexavelent-chromium-providing substance and said coating contains above 10 but not substantially above about 5000 milligrams per square foot of coated substrate of pulverulent metal and not above about 500 milligrams per square foot of coated substrate of chromium, with the coating containing a weight ratio of chromium, as chromium, to pulverulent metal of non-substantially above about 0.5:1, the improvement which comprises: (a) supplying as a topcoating on said established coating a substantially resin free silica substance composition curable to a water resistant protective coating and containing from about 0.5 to about 50 weight percent solids in liquid medium, said composition being applied in an amount sufficient to provide from about 50 to about 2000 milligrams per square foot of coated substrate of silica substance; and (b) curing the applied topcoat composition to said water resistant protective coating.

14. The method of claim 13 wherein said topcoating is cured at a temperature within the range from about 200° F. to about 1000° F.

* * * * *